US010702892B2

(12) United States Patent
Hatch

(10) Patent No.: US 10,702,892 B2
(45) Date of Patent: Jul. 7, 2020

(54) SYSTEM AND METHOD FOR INTELLIGENT CARD SORTING

(71) Applicant: Matthew Hatch, Mount Pleasant, SC (US)

(72) Inventor: Matthew Hatch, Mount Pleasant, SC (US)

( * ) Notice: Subject to any disclaimer, the term of this patent is extended or adjusted under 35 U.S.C. 154(b) by 126 days.

(21) Appl. No.: 16/119,495

(22) Filed: Aug. 31, 2018

(65) Prior Publication Data

US 2020/0070210 A1 Mar. 5, 2020

(51) Int. Cl.
*B07C 5/38* (2006.01)
*B07C 5/342* (2006.01)
*B42F 17/18* (2006.01)

(52) U.S. Cl.
CPC ..... *B07C 5/38* (2013.01); *B07C 5/3422* (2013.01); *B42F 17/18* (2013.01)

(58) Field of Classification Search
CPC ..... B07C 5/38; B07C 5/342; B07C 5/3422
USPC ..... 209/268, 552
See application file for complete search history.

(56) References Cited

U.S. PATENT DOCUMENTS 9,948,802 B2 * 4/2018 Allen ..... B65H 1/04
2008/0001356 A1 * 1/2008 Franks ..... A63F 1/06 273/148 R
2013/0292902 A1 * 11/2013 Shigeta ..... A63F 1/02 273/148 R
2014/0088765 A1 * 3/2014 Valpola ..... B25J 9/1697 700/259
2014/0305847 A1 * 10/2014 Kudrus ..... B23K 26/3584 209/10

* cited by examiner

*Primary Examiner* — Terrell H Matthews
(74) *Attorney, Agent, or Firm* — Polsinellli LLP

(57) ABSTRACT

The present disclosure relates to systems, methods, non-transitory computer readable medium that may be directed to sorting collectable cards. Systems and methods consistent with the present disclosure may move a card such that an image of that card can be acquired an sent to a controller that matches the acquired image or other information included on that card to a feature that is associated with a collectable card. After the controller matches the image or other information on the card to the feature, the controller may identify a bin where the card should be placed and then the controller may cause the card to be dropped into the identified bin when performing a sorting function.

10 Claims, 7 Drawing Sheets

SYSTEM AND METHOD FOR INTELLIGENT CARD SORTING

BACKGROUND OF THE INVENTION

Field of the Invention

The present invention is generally directed to methods and apparatus associated with an intelligent robot when performing a sorting function. More specifically, the present invention identifies bins into which cards or card stock may be placed into by a robotic machine.

Description of the Related Art

Robots are used virtually every day in various ways, for example they are used to place parts on printed circuit boards when those boards are manufactured into printed circuit board assemblies. Robots are also used to assembly cars, vacuum the floor, to fight against other robots, and to perform other autonomous actions.

Today there are many forms of collectable cards, for example POKEMON™ cards and baseball cards can be worth thousands or even millions of dollars. In certain instances only qualified experts have the ability to sort such collectable cards. In other instances, individuals or merchants may have many cards with many features that overwhelm those individuals or merchants.

Since many different collectors or card merchants have little to no way to sort their cards, they would benefit from systems and methods that could help them sort their cards automatically. What are needed a new ways to features or characteristics associated with collectable cards and to sort them automatically based on such features or characteristics.

SUMMARY OF THE PRESENTLY CLAIMED INVENTION

Systems, methods, and non-transitory computer readable medium consistent with the present disclosure relate to performing a function for sorting cards. A system consistent with the present disclosure may include a controller and a moving portion that is moved by one or motors coupled to the moving portion. The moving portion may include a card feeder that holds one or more cards and that controllably moves the one or more cards. The moving portion may also include a sensor coupled to the controller that provides a captured image of a card to the controller. Next the controller may identify a location of a bin based on a feature included on the first card that was matched to a characteristic associated with a sorting function. After a match has been made, the controller may control the movement of the moving portion to the identified bin location and cause the card to be dropped into the identified bin location according to the sorting function.

A method consistent with the present disclosure may use a card feeder to move a card such that an image of that card can be acquired. After the card is moved the image of the card may be acquired and provided to a controller. The controller may then identify a location of a bin based on a feature included on the card that was matched to a characteristic associated with a sorting function, control movement of a moving portion to the identified bin location, and drop the card into the identified bin according to the sorting function.

When the presently claimed method is performed by a non-transitory computer readable storage medium, a processor executing instructions out of a memory may initiate the movement of a card such that an image of that card can be acquired. Next the image of the card can be received by the processor and the processor may then execute instructions out of a memory to match a feature included on the card with a characteristic associated with a sorting function. The processor may then identify a bin location to drop the card and initiate the dropping of the card according to the sorting function.

DETAILED DESCRIPTION

The present disclosure relates to a robot that organizes cards. Robotic systems consistent with the present disclosure may capture images of a collectable card and identify a location where that card should be placed based on features included on that card matching characteristics associated with a type of card, images included on the card, or text printed on the card.

Figure 1:
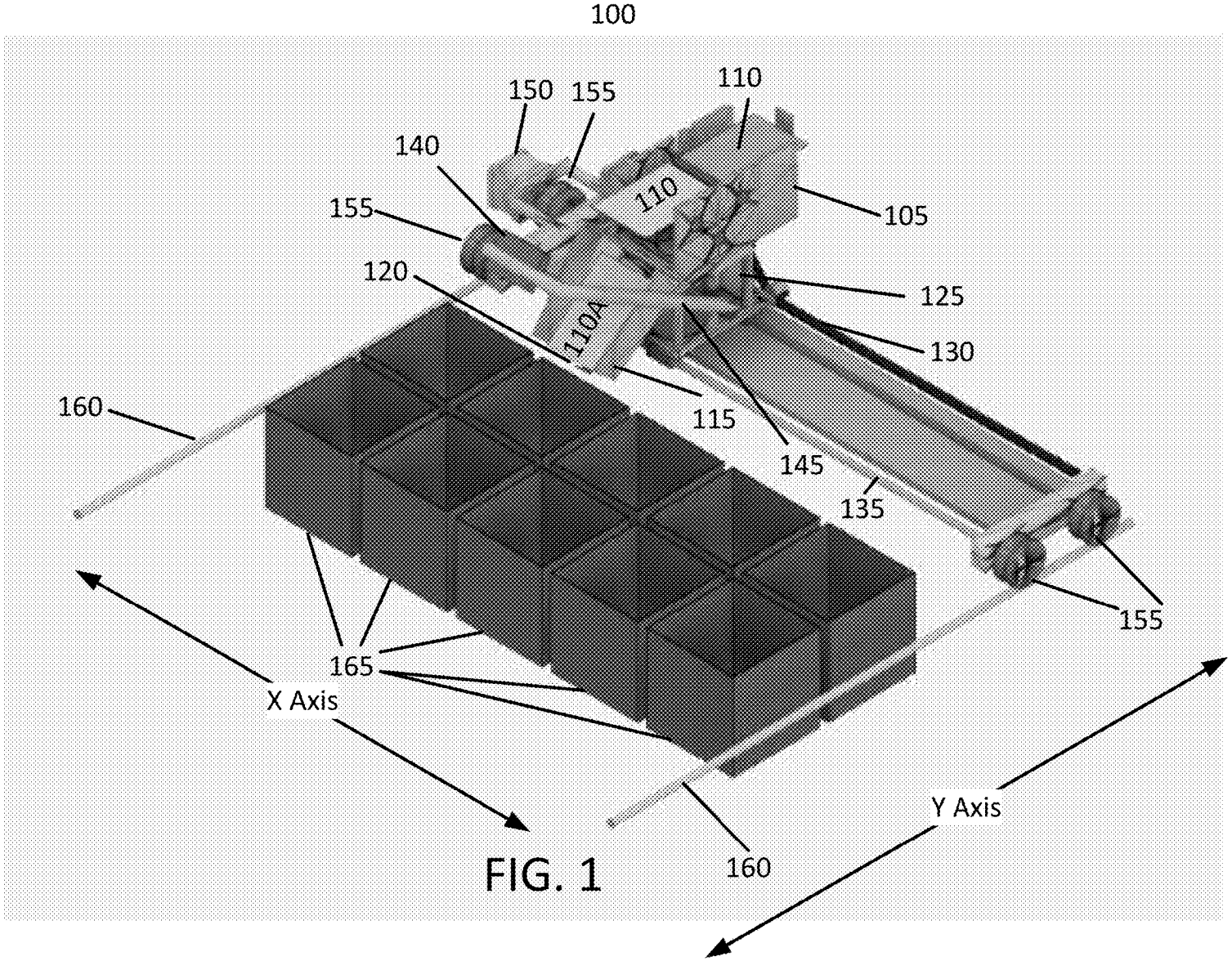
FIG. 1 depicts a robotic system consistent with an embodiment of the present disclosure.

FIG. 1 depicts a robotic system consistent with an embodiment of the present disclosure. System 100 of FIG. 1 includes a card feeder 105 that moves cards 110 toward holding tray 115. Holding tray 115 may hold and drop cards using holding mechanism 120. Robot 100 includes a bottom portion 125 that is connected to card feeder 105 and to holding tray 115. Bottom portion 125 may include control electronics or a control computer. This bottom portion may also include or be coupled to a first motion mechanism 130 that may be used to move bottom portion 125 and holding tray 115 back and forth the along X axis illustrated in FIG. 1 using base 135. FIG. 1 also includes motor 150 that may be coupled to one or more wheels 155 in order to move bottom portion 125 and holding tray 115 forward and backward along the Y axis illustrated in FIG. 1 using rails 160. FIG. 1 also includes camera 140 and bins 165.

Card feeder 105 may feed cards 110 one at a time into holding tray 115 where camera 140 may receive an image of card 110A. Note that holding mechanism 120 may be a solenoid driven latch, clamp, stop, or any other controllable holding mechanism that would prevent card 110A from being immediately dropped from holding tray 115 based on how holding tray 115 is positioned or based on a position of holding mechanism 120.

As or after cards 110 are moved into holding tray 115, camera 140 may acquire an image of those cards. Next a computer may receive images, text, or other data acquired from the card. A controlling computer may identify that card 110A is a POKEMON™ card of that includes a particular character or of a particular type of card. This identification function may be performed using optical character recognition (OCR) or image recognition software that is known in the art.

Once card 110A is identified, the controlling computer may cause at least a portion of robot 100 to move forward, backward, left, or right to align holding tray 115 in a position where holding mechanism 120 may be used to release card 110A to fall into a specific bin on bins 165. As such POKEMON™ cards of a fire type may be dropped into a first bin of bins 165 and POKEMON™ of a water type may be dropped into a second bin of bins 165.

A user of robot 100 may have configured a controlling computer to move and drop cards of particular types or with particular content into any specific bin of bins 165. In another example, Baseball cards may be sorted by various different types of cards. Exemplary card types may correspond to veteran players, most collectable cards, most valuable cards, rookie players, player position (e.g. pitcher, catcher, other), team, or by other notable features that may be included on or associated with different Baseball cards.

Note that in alternative implementations holding tray 115 may pivot from a flat/level position to a position where gravity would cause card 110A to fall. As such holding mechanism 120 may be or include a pivoting/rotating mechanism. While FIG. 1 illustrates the position of card feeder 105 being located in an upper portion of a mechanism, card feeders consistent with the present disclosure may be included elsewhere in a robotic system.

Figure 2:
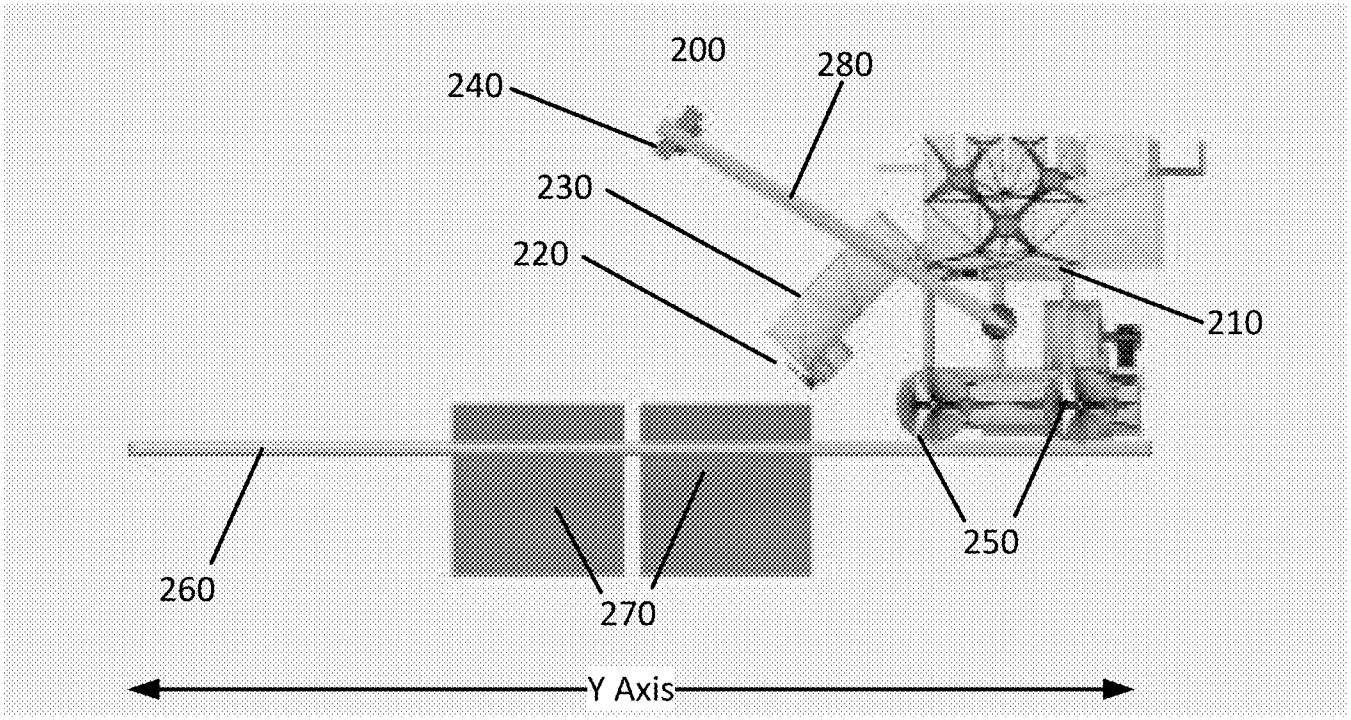
FIG. 2 illustrates an exemplary side view of a robot consistent with the present disclosure.

FIG. 2 illustrates an exemplary side view of a robot consistent with the present disclosure. The robotic system 200 of FIG. 2 includes a robotic part 210 that may move forward or backward along the Y axis included in FIG. 2 using wheels 250 and rails 260. Robotic part 210 may include, for example, the holding tray and the bottom portion included in FIG. 1 that also moves left to right along an X axis not depicted in FIG. 2. FIG. 2 also includes holding tray 230, camera 240, holding mechanism 220, and arm 280.

Here again the robotic system of FIG. 2 may receive a card in holding bin 230, where camera 240 receives an image of that card, and a computer may identify features included on the card when identifying which bin of bins 270 that particular card should be placed. Once the appropriate bin has been identified, a moving part, including camera 240 (held by arm 280), holding tray 230, and holding mechanism 220 may be positioned over an appropriate bin and holding mechanism 220 may release the card into an appropriate bin of bins 270.

Figure 3:
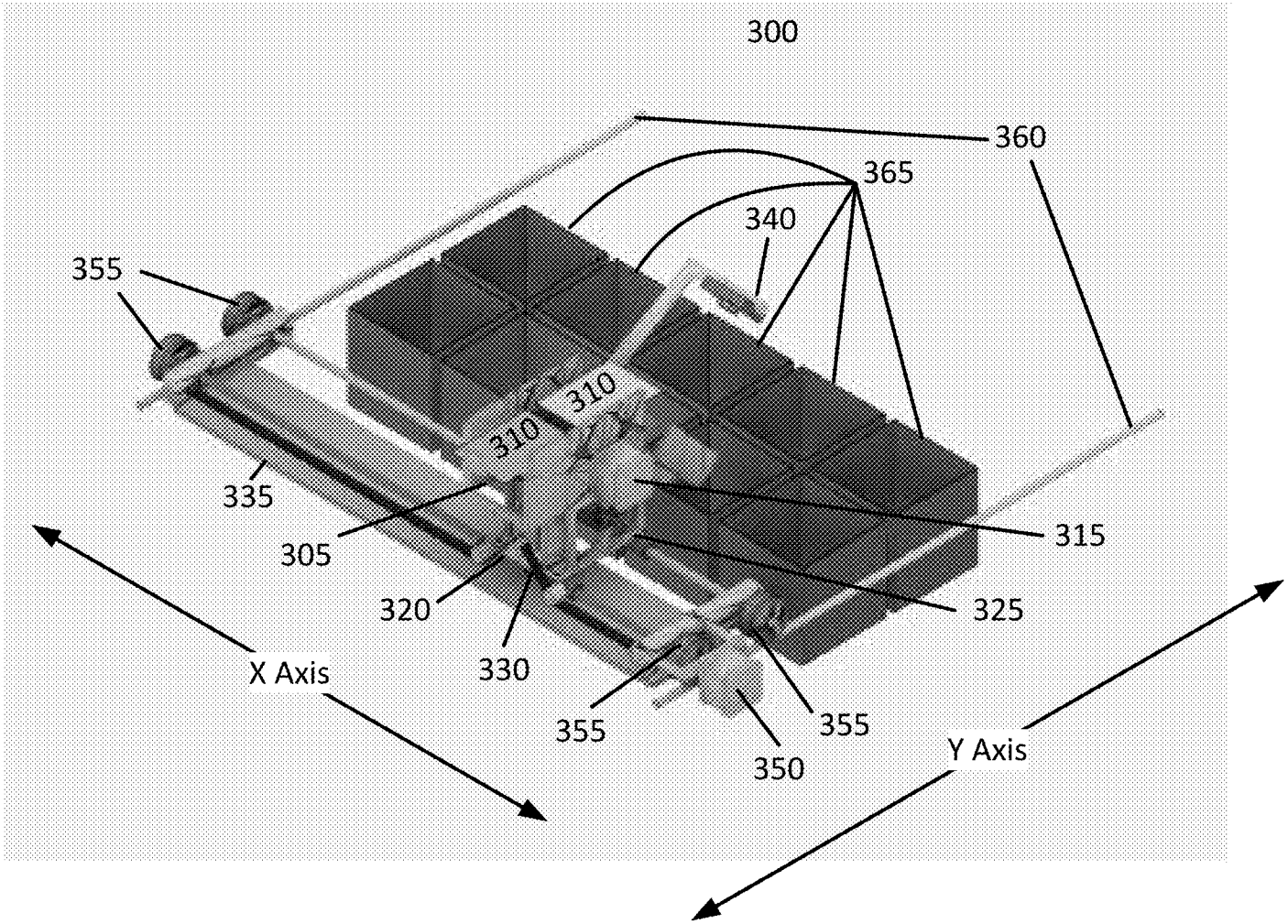
FIG. 3 illustrates an exemplary robotic system consistent with the present disclosure from a perspective behind that robotic system.

FIG. 3 illustrates an exemplary robotic system consistent with the present disclosure from a perspective behind that robotic system. FIG. 3 includes an X axis where a moving portion can move left to right and includes a Y axis where the moving part may move back and forth. FIG. 3 includes many similar features as those illustrated in FIGS. 1 and 2. The moving portion in FIG. 3 may include card feeder 305, bottom portion 325, motor 315, motor 350, motor 320, camera 340, and wheels 355. Here again a moving portion of the robotic system 300 may move and drop a card into an appropriate bin on bins 365 after camera 340 acquired an image of a particular card 310 and after a computer has analyzed information included on that card 310. Card feeder 305 includes motor 315 that may be used to provide cards, one at a time to a holding tray like the holding tray of FIGS. 1 and 2.

Motor 350 of FIG. 3 may be coupled to drive wheels 355 to move moving portion of robotic system 300 back and forth along rails 360. Motor 320 may interact with band 330 to move the moving portion of the robotic system 300 from left to right. In an instance when rotating member attached to motor 320 rotates, the moving portion of the robot system 300 may be moved in a left or right direction.

As reviewed above, robots consistent with the present disclosure may move in at least 2 different directions when sorting cards into an appropriate bin based on one or more settings or configurations.

Figure 4:
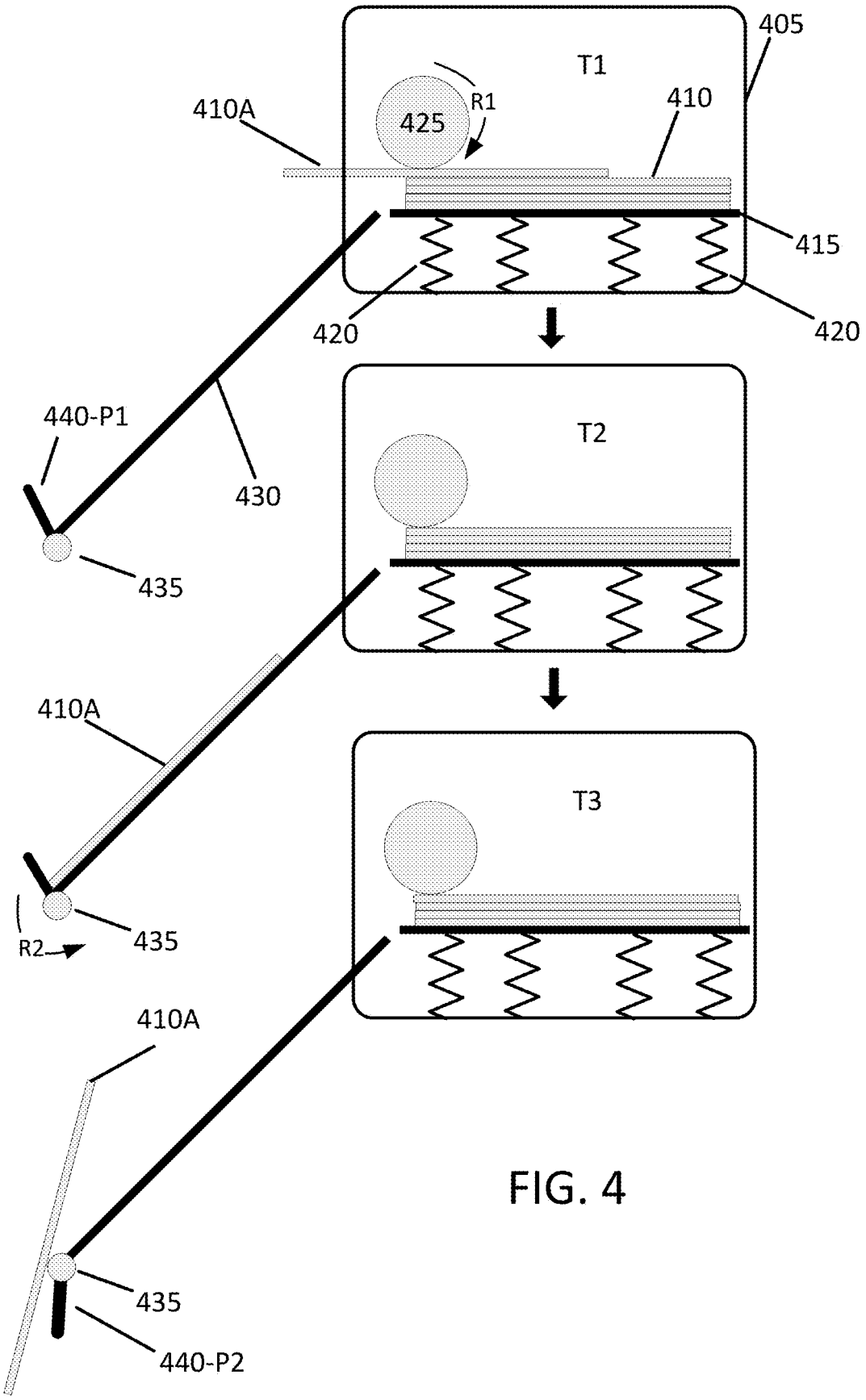
FIG. 4 illustrates an exemplary time-lapse card feeder and holding tray consistent with the present disclosure.

FIG. 4 illustrates an exemplary time-lapse card feeder and holding tray consistent with the present disclosure. FIG. 4 includes card feeder 405 and holding tray 430 at three discrete points in time T1, T2, and T3. Card feeder 405 includes a stack of cards 410 and a card feed platform 415 that is spring loaded by springs 420, where motorized feed wheel 425 may be used to move cards from card feeder 405 to holding tray 430. Holding tray includes rotational member 435 that is attached to holding mechanism 440 that is in a first position as identified by 440-P1 in FIG. 4.

As feed wheel 425 rotates in clockwise R1 direction, card 410A is fed toward holding tray 430 at a first time as illustrated in the top T1 image of the card feeder 405. At time T2, card 410A has been fed into holding tray 430. After a camera captures an image of card 410A and after a control system has identified one or more features associated with the card the control system may position positioned card holder 430 above an appropriate bin. Next rotational member 435 may begin rotating holding member 440 in counter clockwise R2 direction. At time T3, rotational member 440 is in position 440-P2 where card 410A is released from card holder 430 and dropped into a bin. After card 410A has been dropped into a bin, rotational member 435 may rotate holding member back into position 440-P1 and feed wheel 425 may then feed another card into holding tray 430 as cards are sorted and placed into appropriate bins.

Holding members or mechanisms may drop cards using either a mechanism that rotates or that provides a linear motion. For example, the entire holding tray could rotate to drop a card. In another example, one or more retractable pins coupled to a solenoid may be used to cause a holding member to move. In another example, a solenoid may drive a member in direction such that the driving member pushes the card off of a platform associated with the holding member. In another example, a holding mechanism may include a feed wheel similar to the feed wheel 425, where the feed wheel in the holding mechanism may hold cards when not rotating or that may drop cards by rotating of that feed wheel.

In certain instances a sensor or camera may be included in the card feeder, where the card feeder also performs the function of the card holder. In such an instance a sensor or camera in the card feeder may be used to capture images of a card after which the controller may receive that image, match features in that card to a sorting characteristic, move the robot to an identified location, and drop the card in a bin at the identified location.

Figure 5:
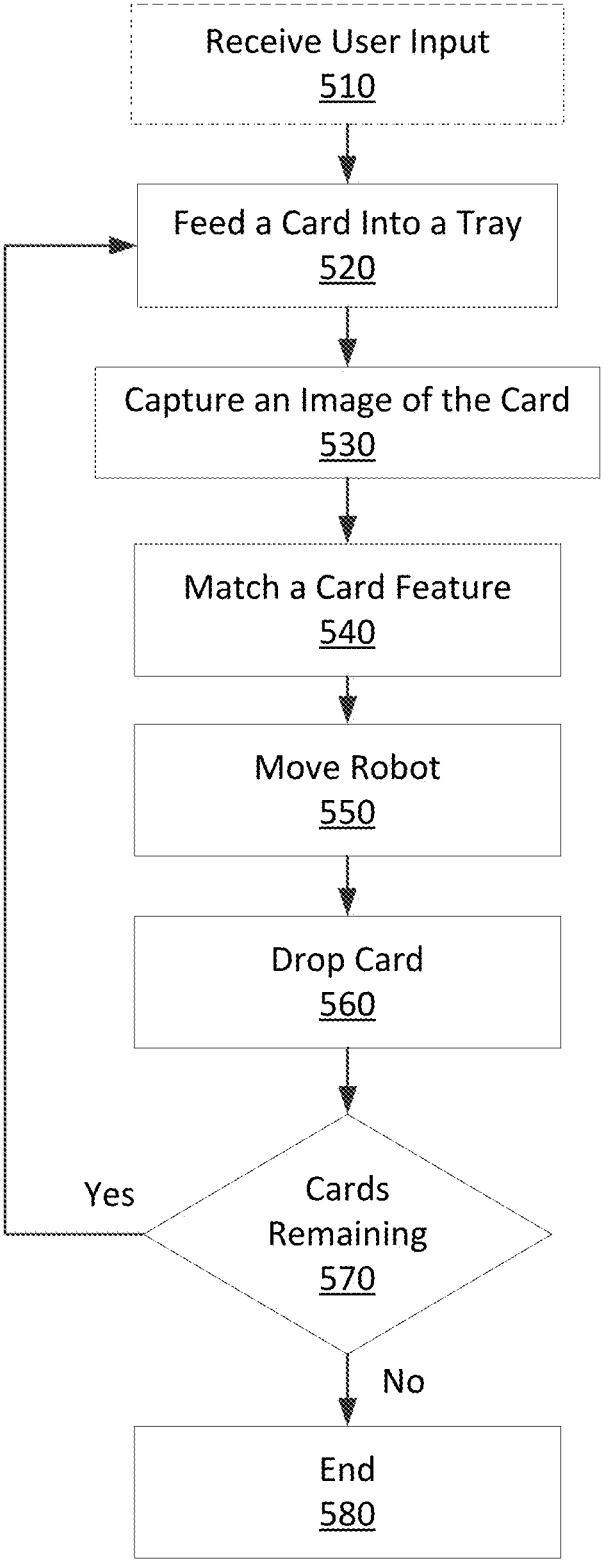
FIG. 5 illustrates exemplary steps that may be performed by a controller consistent with the present disclosure.

FIG. 5 illustrates exemplary steps that may be performed by a controller consistent with the present disclosure. FIG. 5 includes optional step 510 where user input is received. The received user input may identify features that may be used by a program executed by a processor that sorts cards based on information captured from images from particular cards. Such a program may match images included on particular cards with images stored in a memory or database. Alternatively or additionally a sorting program may identify text or words that are printed on a card when performing a sorting function. A sorting program consistent with the present disclosure may use optical character recognition or image recognition that matches stored characters, words, or images to characters, words, or images stored in a database.

The user input received at step 510 could include a user selection of an image or user input of text or words that can be used to sort cards by images, text, or words that have been captured by a camera. Methods consistent with the present disclosure may also sort cards based on criteria or features that were identified by other means. For example, card sorting criteria may be provided with a set of computer software or be downloadable to a computing device such that cards can be sorted according to the criteria prepared by others, by experts, for example.

After step 510, step 520 feeds a card into a holding tray, where an image of the card is captured in step 530 of FIG. 5. Next, in step 540 one or more features included on the card may be matched to features included in a database when that card is sorted into a particular class or type of card. Step 540 may also identify a bin that the card should be dropped into based on the features that match a particular card class or type. After step 540, program flow moves to step 550 where a robot consistent with the present disclosure is moved such that the card can be dropped into the identified bin. Then in step 560 the card may be dropped into the identified bin. After step 560, determination step 570 may identify whether the card feeder includes remaining cards, when yes program flow may move back to step 520, where another card is fed into the holding tray. When determination step 570 identifies that there are no more cards remaining, program flow may end in step 580 of FIG. 5.

Note determination step 570 may be implemented using one or more sensors that are coupled to a processor. This may be accomplished by using optical sensors, by sensing the position of a card tray (such as card tray 415 of FIG. 4), by an element that only touches a card tray when no cards are left in that tray, or by other sensing means. Similarly, sensors coupled to a processor may also sense the presence or absence of a card in a holding tray. Sensors monitoring a holding tray can be used to identify when a card has been moved to the holding tray and this may cause the processor to stop moving cards into the holding tray until after the holding tray is emptied. Sensors monitoring the holding tray may also be used to identify that a card has not been dropped when it should have been.

Control systems consistent with the present disclosure may include a processor and memory that control card feeding, image acquisition, robot motion, and card dropping. Such control systems may also be implemented by a field programmable gate array (FPGA), an application specific integrated circuit (ASIC), analog electronics, digital electronics, or combination thereof.

A system consistent with the present disclosure may also use various different types of actuation mechanisms than those illustrated and discussed in the present disclosure. For example, actuation systems may include wheels and rails, yet are not limited to them as they may also use belts, chains, or gears. In certain instances, systems consistent with the present disclosure may be expandable by adding length to a set of rails or by adding wheels to an actuation system.

Figure 6:
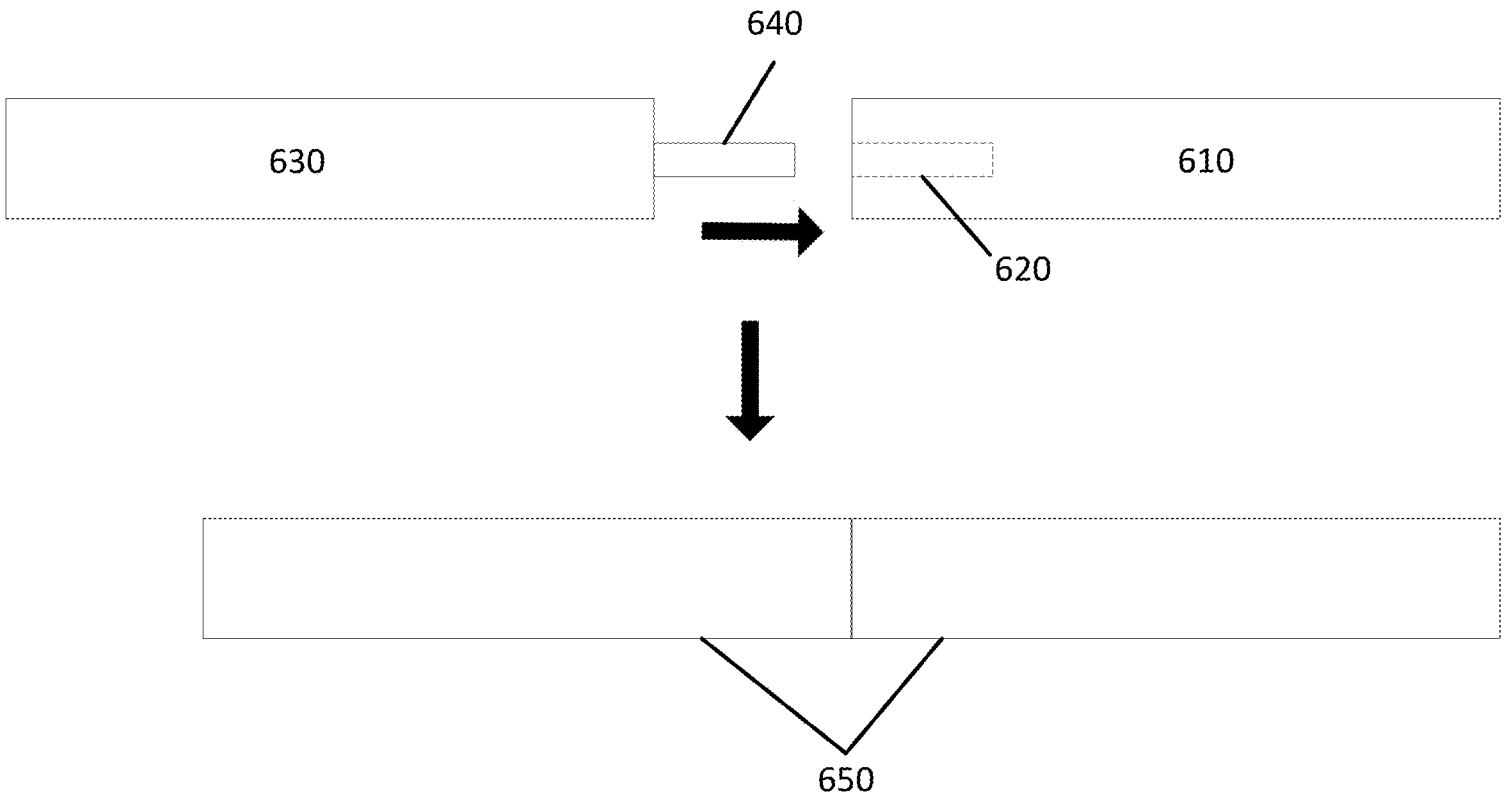
FIG. 6 illustrates an extensible rail that may be used in systems consistent with the present disclosure.

FIG. 6 illustrates an extensible rail that may be used in systems consistent with the present disclosure. FIG. 6 includes rail member 610 that includes hole 620. FIG. 6 also includes a new rail member 630 that includes extension or pin 640. Note that the arrow moving from left to right in FIG. 6. Indicates that the extension or pin 640 may be inserted into hole 620 when rail member 630 is attached to rail member 610. Note that the process of connecting rail members 610 and 630 together results in a longer combined rail member 650. As such rails that may be used in systems consistent with the present disclosure may be extended without changing a height or a width associated with rail members of such a system.

Figure 7:
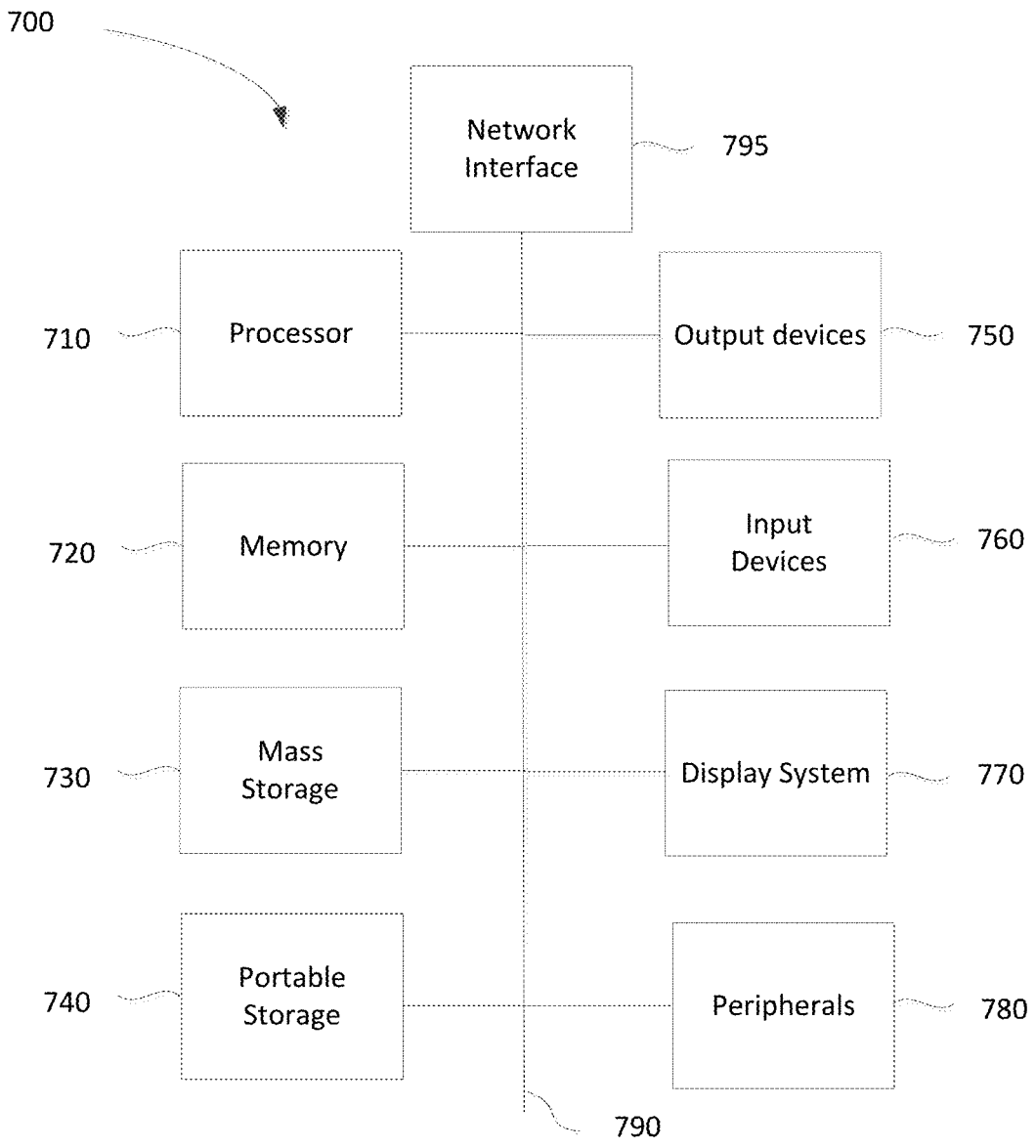
FIG. 7 illustrates a computing system that may be used to implement an embodiment of the present invention.

FIG. 7 illustrates a computing system that may be used to implement an embodiment of the present invention. The computing system 700 of FIG. 7 includes one or more processors 710 and main memory 720. Main memory 720 stores, in part, instructions and data for execution by processor 710. Main memory 720 can store the executable code when in operation. The system 700 of FIG. 7 further includes a mass storage device 730, portable storage medium drive(s) 740, output devices 750, user input devices 760, a graphics display 770, peripheral devices 780, and network interface 795.

The components shown in FIG. 7 are depicted as being connected via a single bus 790. However, the components may be connected through one or more data transport means. For example, processor unit 710 and main memory 720 may be connected via a local microprocessor bus, and the mass storage device 730, peripheral device(s) 780, portable storage device 740, and display system 770 may be connected via one or more input/output (I/O) buses.

Mass storage device 730, which may be implemented with a magnetic disk drive or an optical disk drive, is a non-volatile storage device for storing data and instructions for use by processor unit 710. Mass storage device 730 can store the system software for implementing embodiments of the present invention for purposes of loading that software into main memory 720.

Portable storage device 740 operates in conjunction with a portable non-volatile storage medium, such as a FLASH memory, compact disk or Digital video disc, to input and output data and code to and from the computer system 700 of FIG. 7. The system software for implementing embodiments of the present invention may be stored on such a portable medium and input to the computer system 700 via the portable storage device 740.

Input devices 760 provide a portion of a user interface. Input devices 760 may include an alpha-numeric keypad, such as a keyboard, for inputting alpha-numeric and other information, or a pointing device, such as a mouse, a trackball, stylus, or cursor direction keys. Additionally, the system 700 as shown in FIG. 7 includes output devices 750. Examples of suitable output devices include speakers, printers, network interfaces, and monitors.

Display system 770 may include a liquid crystal display (LCD), a plasma display, an organic light-emitting diode (OLED) display, an electronic ink display, a projector-based display, a holographic display, or another suitable display device. Display system 770 receives textual and graphical information, and processes the information for output to the display device. The display system 770 may include multiple-touch touchscreen input capabilities, such as capacitive touch detection, resistive touch detection, surface acoustic wave touch detection, or infrared touch detection. Such touchscreen input capabilities may or may not allow for variable pressure or force detection.

Peripherals 780 may include any type of computer support device to add additional functionality to the computer system. For example, peripheral device(s) 780 may include a modem or a router.

Network interface 795 may include any form of computer interface of a computer, whether that be a wired network or a wireless interface. As such, network interface 795 may be an Ethernet network interface, a BLUETOOTH™ wireless interface, an 802.11 interface, or a cellular phone interface.

The components contained in the computer system 700 of FIG. 7 are those typically found in computer systems that may be suitable for use with embodiments of the present invention and are intended to represent a broad category of such computer components that are well known in the art. Thus, the computer system 700 of FIG. 7 can be a personal computer, a hand held computing device, a telephone ("smart" or otherwise), a mobile computing device, a workstation, a server (on a server rack or otherwise), a minicomputer, a mainframe computer, a tablet computing device, a wearable device (such as a watch, a ring, a pair of glasses, or another type of jewelry/clothing/accessory), a video game console (portable or otherwise), an e-book reader, a media player device (portable or otherwise), a vehicle-based computer, some combination thereof, or any other computing device. The computer can also include different bus configurations, networked platforms, multi-processor platforms, etc. The computer system 700 may in some cases be a virtual computer system executed by another computer system. Various operating systems can be used including Unix, Linux, Windows, Macintosh OS, Palm OS, Android, iOS, and other suitable operating systems.

The present invention may be implemented in an application that may be operable using a variety of devices. Non-transitory computer-readable storage media refer to any medium or media that participate in providing instructions to a central processing unit (CPU) for execution. Such media can take many forms, including, but not limited to, non-volatile and volatile media such as optical or magnetic disks and dynamic memory, respectively. Common forms of non-transitory computer-readable media include, for example, FLASH memory, a flexible disk, a hard disk, magnetic tape, any other magnetic medium, a CD-ROM disk, digital video disk (DVD), any other optical medium, RAM, PROM, EPROM, a FLASH EPROM, and any other memory chip or cartridge.

The present invention may be implemented in an application that may be operable using a variety of devices. Non-transitory computer-readable storage media refer to any medium or media that participate in providing instructions to a central processing unit (CPU) for execution. Such media can take many forms, including, but not limited to, non-volatile and volatile media such as optical or magnetic disks and dynamic memory, respectively. Common forms of non-transitory computer-readable media include, for example, a floppy disk, a flexible disk, a hard disk, magnetic tape, any other magnetic medium, a CD-ROM disk, digital video disk (DVD), any other optical medium, RAM, PROM, EPROM, a FLASH EPROM, and any other memory chip or cartridge.

While various flow diagrams provided and described above may show a particular order of operations performed by certain embodiments of the invention, it should be understood that such order is exemplary (e.g., alternative embodiments can perform the operations in a different order, combine certain operations, overlap certain operations, etc.).

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claim.

What is claimed is:

1. A sorting system, the system comprising:
- a controller;
- a robot that can be controllably moved in one or more directions, the robot comprising:
  - a card feeder that holds one or more cards and that controllably moves the one or more cards; and
  - a sensor coupled to the controller that provides images to the controller; and
- one or more motors that move the robot in the one or more directions, wherein:
  - the card feeder moves a first card of the one or more cards,
  - the sensor captures and provides an image of the first card to the controller,
  - the controller identifies a location of a bin based on a feature included on the first card that was matched to a characteristic associated with a sorting function,
  - the controller controls movement of the robot to the identified bin location, and
  - the first card is dropped into the identified bin according to the sorting function.

2. The system of claim 1, further comprising a card holder that controllably receives the first card from the card feeder before the sensor captures the image of the first card.

3. The system of claim 1, wherein the sensor is a camera.

4. The system of claim 1, wherein the controller includes a memory and a processor that executes instructions out of the memory.

5. The system of claim 1, further comprising one or more sensors coupled to the controller.

6. The system of claim 5, wherein the one or more sensors include a sensor that senses that a card is located in the card feeder.

7. The system of claim 2, further comprising a sensor that senses that a card is located in the card holder.

8. The system of claim 2, further comprising a holding mechanism attached to the card holder that drops the first card.

9. The system of claim 8, wherein the controller initiates movement of the holding mechanism to drop the first card.

10. The system of claim 8, wherein the holding mechanism moves using at least one of a rotational motion or a linear motion.

* * * * *